US010260295B2

(12) United States Patent
Zhou

(10) Patent No.: US 10,260,295 B2
(45) Date of Patent: Apr. 16, 2019

(54) MITIGATING DRILLING CIRCULATION LOSS

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 15 days.

(21) Appl. No.: 15/606,501

(22) Filed: May 26, 2017

(65) Prior Publication Data

US 2018/0340381 A1 Nov. 29, 2018

(51) Int. Cl.

| | |
|---|---|
| ***E21B 10/02*** | (2006.01) |
| ***E21B 21/00*** | (2006.01) |
| ***E21B 4/02*** | (2006.01) |
| ***E21B 25/00*** | (2006.01) |
| ***E21B 43/10*** | (2006.01) |
| ***E21B 17/18*** | (2006.01) |
| *E21B 33/12* | (2006.01) |

(52) U.S. Cl.

CPC ..... *E21B 21/003* (2013.01); *E21B 4/02* (2013.01); *E21B 10/02* (2013.01); *E21B 17/18* (2013.01); *E21B 25/00* (2013.01); *E21B 43/10* (2013.01); *E21B 33/12* (2013.01)

(58) Field of Classification Search

CPC ..... E21B 21/003; E21B 4/02; E21B 10/25; E21B 25/00; E21B 43/10; E21B 33/12

See application file for complete search history.

(56) References Cited

U.S. PATENT DOCUMENTS 1,435,491 A * 11/1922 Presse ..... E21B 10/325 175/260

2,277,989 A 3/1942 Kinnear (Continued)

FOREIGN PATENT DOCUMENTS

| | | |
|---|---|---|
| CA | 2521287 | 4/2006 |
| CA | 2867574 | 10/2013 |

(Continued)

OTHER PUBLICATIONS

Schlumberger, "TDDirect Case-drilling and liner-drilling technology," 2013; 20 pages.

(Continued)

*Primary Examiner* — D. Andrews
*Assistant Examiner* — Yanick A Akaragwe
(74) *Attorney, Agent, or Firm* — Fish & Richardson P.C.

(57) ABSTRACT

Mitigating drilling circulation loss can be implemented as a wellbore drilling system that includes a drilling liner and a drill head assembly. The drilling liner is configured to be positioned in a lost circulation zone of a subterranean formation in which a wellbore is being drilled. The drilling liner is configured to flow wellbore drilling fluids from a surface of the wellbore to the subterranean formation while avoiding the lost circulation zone. The drill head assembly is attached to a downhole end of the drilling liner, and is configured to drill the subterranean formation to form cuttings, receive the wellbore drilling fluids, and flow the cuttings and the wellbore drilling fluids into the drilling liner while avoiding the lost circulation zone and towards the surface of the wellbore.

19 Claims, 11 Drawing Sheets

(56) References Cited

U.S. PATENT DOCUMENTS

| | | | | |
|---|---|---|---|---|
| 2,657,016 | A * | 10/1953 | Grable | E21B 10/04 175/206 |
| 2,945,541 | A | 7/1960 | Maly et al. | |
| 3,253,655 | A | 5/1966 | Brown | |
| 3,419,092 | A | 12/1968 | Elenburg | |
| 3,503,461 | A * | 3/1970 | Shirley | E21B 21/00 166/187 |
| 3,600,039 | A * | 8/1971 | Porter | E21B 43/10 299/5 |
| 3,674,100 | A | 7/1972 | Becker | |
| 4,373,592 | A | 2/1983 | Dellinger et al. | |
| 4,754,819 | A | 7/1988 | Dellinger | |
| 4,790,396 | A * | 12/1988 | Fuller | E21B 10/02 175/249 |
| 5,472,057 | A | 12/1995 | Winfree | |
| 5,803,178 | A | 9/1998 | Cain | |
| 5,845,722 | A | 12/1998 | Makohl et al. | |
| 5,901,797 | A | 5/1999 | Hansen | |
| 6,196,336 | B1 | 3/2001 | Fincher et al. | |
| 6,481,501 | B2 | 11/2002 | Chavez | |
| 6,854,533 | B2 | 2/2005 | Galloway et al. | |
| 6,988,557 | B2 | 1/2006 | Whanger et al. | |
| 6,997,272 | B2 | 2/2006 | Eppink | |
| 7,093,675 | B2 | 8/2006 | Pia | |
| 7,108,080 | B2 | 9/2006 | Tessari et al. | |
| 7,134,514 | B2 | 11/2006 | Riel et al. | |
| 7,152,700 | B2 | 12/2006 | Church et al. | |
| 7,174,975 | B2 | 2/2007 | Krueger | |
| 7,204,327 | B2 | 4/2007 | Livingstone | |
| 7,228,915 | B2 | 6/2007 | Thomson | |
| 7,334,650 | B2 | 2/2008 | Giroux | |
| 7,631,695 | B2 | 12/2009 | Schafer et al. | |
| RE41,118 | E | 2/2010 | Brezinski et al. | |
| 7,942,199 | B2 | 5/2011 | Angman | |
| 8,225,880 | B2 | 7/2012 | Rytlewski et al. | |
| 8,276,689 | B2 | 10/2012 | Giroux et al. | |
| 9,022,146 | B2 | 5/2015 | Krueger | |
| 9,057,236 | B2 | 6/2015 | Hogset et al. | |
| 9,187,968 | B2 | 11/2015 | Holte | |
| 9,255,448 | B2 | 2/2016 | Oesterberg et al. | |
| 9,511,402 | B2 | 12/2016 | Hayashi et al. | |
| 9,816,331 | B2 | 11/2017 | Le | |
| 2003/0155156 | A1 | 8/2003 | Livingstone | |
| 2003/0183396 | A1 | 10/2003 | Adams | |
| 2004/0079553 | A1 | 4/2004 | Livingstone | |
| 2004/0124010 | A1 | 7/2004 | Galloway | |
| 2004/0216892 | A1 | 11/2004 | Giroux | |
| 2005/0098349 | A1 | 5/2005 | Krueger | |
| 2005/0274547 | A1 | 12/2005 | Fincher et al. | |
| 2007/0144784 | A1 | 6/2007 | Head | |
| 2008/0236809 | A1 | 10/2008 | Livingstone | |
| 2009/0090508 | A1 | 4/2009 | Brouse | |
| 2009/0101413 | A1 | 4/2009 | Abt | |
| 2009/0107675 | A1 | 4/2009 | Eriksen | |
| 2010/0314134 | A1 | 12/2010 | Nutley et al. | |
| 2011/0278069 | A1 | 11/2011 | Ahonen | |
| 2012/0168178 | A1 | 7/2012 | Eriksen | |
| 2012/0181044 | A1 | 7/2012 | Nikiforuk | |
| 2012/0211279 | A1 | 8/2012 | Neidhardt | |
| 2012/0222861 | A1 | 9/2012 | Eriksen | |
| 2013/0068481 | A1 * | 3/2013 | Zhou | E21B 43/10 166/381 |
| 2013/0118752 | A1 * | 5/2013 | Hannegan | E21B 47/0005 166/336 |
| 2014/0034391 | A1 | 2/2014 | Eidem | |
| 2014/0083776 | A1 | 3/2014 | Hogset | |
| 2014/0196910 | A1 | 7/2014 | Le | |
| 2015/0136393 | A1 | 5/2015 | Turley | |
| 2015/0226012 | A1 | 8/2015 | Zhou | |
| 2015/0240567 | A1 | 8/2015 | Grable | |
| 2015/0252639 | A1 | 9/2015 | Barison | |
| 2016/0201410 | A1 | 7/2016 | Zhou | |
| 2016/0362958 | A1 | 12/2016 | Zhou | |
| 2016/0362959 | A1 | 12/2016 | Zhou | |
| 2017/0175468 | A1 | 6/2017 | Vail, III | |
| 2018/0150660 | A1 | 5/2018 | Ownby | |

FOREIGN PATENT DOCUMENTS

| | | |
|---|---|---|
| EP | 1006260 B1 | 4/2004 |
| EP | 1907663 | 4/2008 |
| GB | 2088440 | 6/1982 |
| GB | 2396870 | 7/2004 |
| WO | 2004018827 | 3/2004 |
| WO | 2006131339 | 12/2006 |
| WO | 2007126833 | 11/2007 |
| WO | 2014067590 | 5/2014 |
| WO | 2014110441 | 7/2014 |

OTHER PUBLICATIONS

Weatherford, "Drilling-with-Casing (DwC) Systems," Advanced Wellbore Construction, 12 pages.

Long, "Chapter 13: Emerging Drilling Technologies," Petroleum Engineering Handbook, vol. II—Drilling Engineering, Society of Petroleum Engineers, 2006, 20 pages.

International Search Report and Written Opinion issued in International Application No. PCT/US2016/013200 dated Apr. 8, 2016, 13 pages.

International Search Report and Written Opinion issued in International Application No. PCT/US2015/015016 dated Jun. 2, 2015, 11 pages.

International Search Report and Written Opinion issued in International Application No. PCT/US2018/033860 dated Aug. 20, 2018, 13 pages.

* cited by examiner

MITIGATING DRILLING CIRCULATION LOSS

TECHNICAL FIELD

This disclosure relates to wellbore drilling.

BACKGROUND

In wellbore drilling situations that use a drilling rig, a drilling fluid circulation system circulates (or pumps) drilling fluid (for example, drilling mud) with one or more mud pumps. The drilling fluid circulation system moves drilling mud down into the wellbore through a drill string that is made up of special pipe (referred to as drill pipe) and drill collars and or other downhole drilling tools. The fluid exits through ports (jets) in the drill bit, picking up cuttings and carrying the cuttings up the annulus of the wellbore. At the surface, the mud and cuttings leave the wellbore through an outlet, and are sent to a cuttings removal system, for example, via a mud return line. At the end of the return lines, the mud and the cuttings are flowed onto a vibrating screen known as a shale shaker. Finer solids may be removed by a sand trap such as a dedicated solid removal equipment. The mud may be treated with chemicals stored in a chemical tank and then provided into the mud tank, where the process is repeated.

The drilling fluid circulation system delivers large volumes of mud flow under pressure during drilling rig operations. The circulation system delivers the mud to the drill string to flow down the string of drill pipe and out through the drill bit appended to the lower end of the drill string. In addition to cooling the drill bit, the mud hydraulically washes away the face of the wellbore through a set of jets in the drill bit. The mud additionally washes away debris, rock chips, and cuttings, which are generated as the drill bit advances. The circulation system flows the mud in an annular space on the outside of the drill string and on the interior of the open hole formed by the drilling process. In this manner, the circulation system flows the mud through the drill bit and out of the wellbore.

Sometimes a severe lost circulation zone (also known as a high-loss zone) is encountered during the drilling operation. A severe lost circulation zone is a highly permeable or fractured section in the formation where the pressure of the formation is significantly lower than the hydrostatic pressure of the drilling mud. The permeability (ease of flow through the rock formation) allows the drilling mud to enter the formation rather than return to the surface through the annulus of the wellbore. When drilling in a lost circulation zone, a large portion of or all of the drilling fluid that exits the drilling bit can be lost into the lost circulation zone instead of flowing to the surface. Such loss in drilling fluid, in a lost circulation zone can result, among other issues, in expensive downtime and loss of well control.

SUMMARY

This disclosure describes technologies relating to mitigate drilling fluid circulation loss, for example, in lost circulation zones.

Certain aspects of the subject matter described here can be implemented as a wellbore drilling system that includes a drilling liner and a drill head assembly. The drilling liner is configured to be positioned in a lost circulation zone of a subterranean formation in which a wellbore is being drilled. The drilling liner is configured to flow wellbore drilling fluids from a surface of the wellbore to the subterranean formation while avoiding the lost circulation zone. The drill head assembly is attached to a downhole end of the drilling liner, and is configured to drill the subterranean formation to form cuttings, receive the wellbore drilling fluids, and flow the cuttings and the wellbore drilling fluids into the drilling liner while avoiding the lost circulation zone and towards the surface of the wellbore.

This, and other aspects, can include one or more of the following features. The system can include an inner work string configured to be positioned in the drilling liner. A liner annulus can be defined between an outer surface of the inner work string and an inner surface of the drilling liner. The system can include a mud motor attached to the inner work string between the drill head assembly and the inner work string. The mud motor can rotate the drill head assembly. The drill head assembly can be attached to a downhole end of the inner work string to form a closed flow path through which the wellbore drilling fluids flow to avoid the lost circulation zone. The drill head assembly can receive the wellbore drilling fluids flowed through the inner work string and can flow the wellbore drilling fluids and the cuttings into the liner annulus. The drill head assembly can include a coring tool and a drilling bit. The coring tool can core the subterranean formation in which the wellbore is being drilled. The drilling bit can be attached to the inner work string and can cut a core cored by the coring tool. The coring tool can be positioned between the drilling bit and the subterranean formation. A distance between a downhole end of the coring tool and the drilling bit can be substantially three feet. Multiple bearings can be positioned at an interface of the drilling liner and the coring tool, and can allow the coring tool to rotate independently of the drilling liner. The drilling bit can include cutter arms that can include a first end attached to the drilling bit, and a second end protruding away from the drilling bit and toward the subterranean zone. The coring tool can include a notch on an inner surface of the coring tool, which can receive the cutter arms of the drilling bit. The multiple bearings can be positioned uphole of the notches. The cutter arms of the drilling bit can be pivoted about respective pivot locations on the drilling bit toward and away from a longitudinal axis of the drilling liner. A liner running and setting tool can be attached to an uphole end of the drilling liner. The liner running and setting tool can position the drilling liner in the lost circulation zone and to transfer torque to rotate the drilling liner. A return flow control subsystem can be attached to an uphole end of the drilling liner. The return flow control subsystem can receive and flow the wellbore drilling fluid and the cuttings to flow towards the surface of the wellbore. The return flow control subsystem can include an inflatable packer that can seal the drilling liner against the wellbore casing, and flow passages to flow the drilling fluids mixed with the cuttings from the liner annulus to the wellbore casing annulus. The return flow control subsystem can include an inner body surrounded by the inflatable packer, and multiple bearings positioned between the inner body and the inflatable packer. The multiple bearings can allow rotation of the inner body independently of the inflatable packer. At least a portion of the return flow control subsystem can be positioned within a wellbore casing. The drilling liner can include a stop ring that can be attached at a location downhole from the return flow control subsystem. The stop ring can divert the wellbore drilling fluids mixed with the cuttings towards the flow passages. At least an uphole portion of the drilling liner can be positioned within a wellbore casing.

Certain aspects of the subject matter described here can be implemented as a method. A flow path through which a wellbore drilling fluid is flowed to a subterranean formation is isolated from a lost circulation zone of the subterranean formation. While drilling a wellbore through the lost circulation zone, the wellbore drilling fluid is circulated through the flow path while avoiding contact between the wellbore drilling fluid and the lost circulation zone.

This, and other aspects, can include one or more of the following features. The wellbore drilling fluid can be flowed from a surface of the wellbore through the flow path to drill the wellbore. Cuttings resulting from drilling the wellbore and the wellbore drilling fluid can be flowed through the flow path to the surface while avoiding contact between the cuttings and the lost circulation zone. The wellbore can be drilled by removing a core from the subterranean zone using a coring tool, and cutting the core using a drilling bit attached to coring tool.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1A:
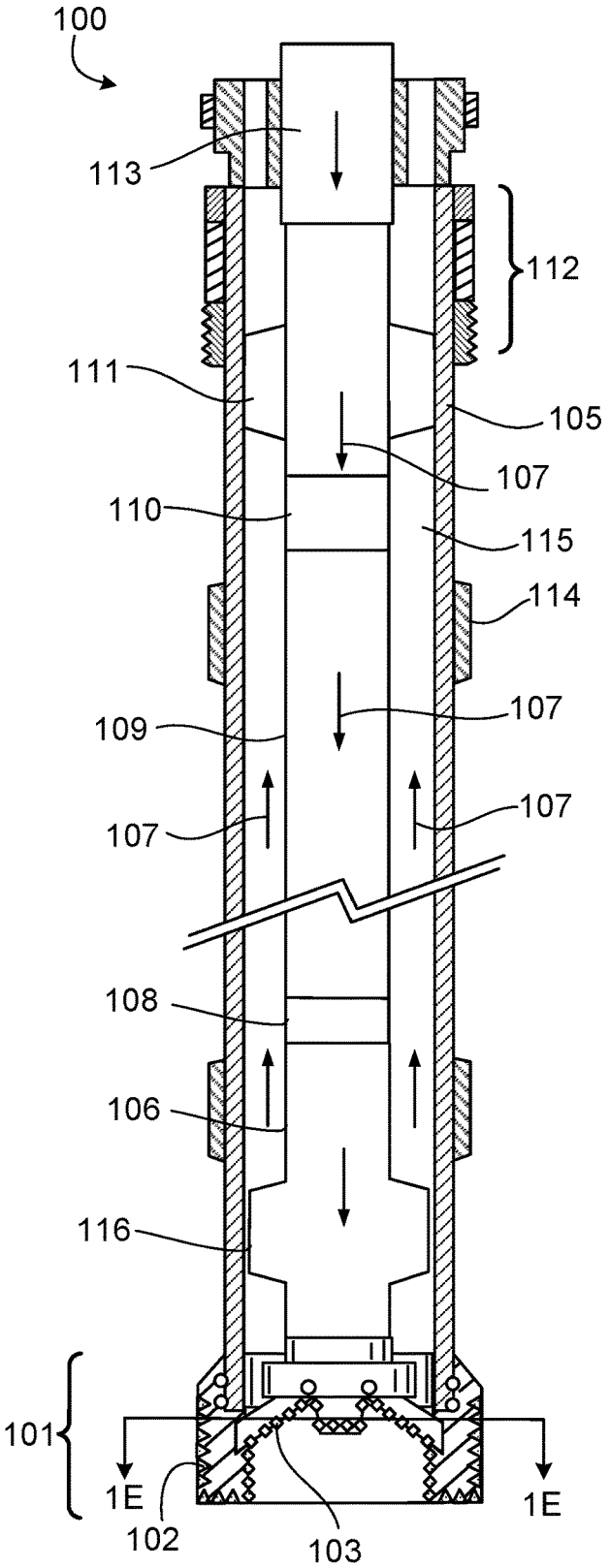
FIG. 1A is a schematic diagram of side-cross sectional view a drilling system to mitigate loss circulation.

This disclosure describes downhole wellbore drilling liner systems and methods for implementing the same. As described in detail with reference to the following figures, an example system includes a drilling liner that isolates wellbore drilling fluid from a subterranean formation while permitting the drilling fluid to flow to a drill head assembly that drills a wellbore and carries cuttings away from the drilled portion of the subterranean formation. In particular, the drilling liner avoids contact between a lost circulation zone through which the wellbore is being drilled and the wellbore drilling fluid.

By implementing the downhole wellbore drilling system described, the drilling liner system can proactively limit the uncontrolled loss of drilling fluids into the subterranean formation, particularly, into severe lost circulation zones. The tools described can be implemented to be simple and robust, thereby decreasing cost to manufacture the tools. In some instances, the tool system can be used any time a lost circulation zone is encountered during drilling operations. The drilling liner system can be packaged as a bottom-hole assembly (BHA) that can be kept on a drilling platform and deployed quickly once a lost circulation zone is encountered, or prior to entering into the loss zone. The tool system can be used from the beginning of the lost circulation zone downhole to the next casing point. Implementing the techniques described can also reduce rig delays or non-productive time (NPT) and eliminate or minimize the need to use loss circulation mitigation materials within the drilling fluid. The cost of wellbore drilling fluids and the cost of implementing loss circulation mitigation materials currently available can also be reduced. Downtime that can result from needing to stop drilling after encountering severe losses, to pump conventional heavy-loaded loss circulation mitigation or specialty pills, or run and set a drillable plug to perform squeeze of cement slurry followed by drill-out can be avoided. The described system has no floating equipment or liner shoe to drill out. Cuttings from lost circulation zones can be recovered at the surface allowing studies of such cuttings to better understand lost circulation zones, which otherwise is not possible to be obtained in conventional drilling mode. Also because of cuttings obtained from the lost circulation zones, the drilling liner setting depth can be better or more securely determined by the formation lithology with more competent rock characteristics. The drilling liner system described can also avoid formation damage in the reservoir section by eliminating a large dynamic mud pressure variation conventionally imposed onto the rock formation. The drilling liner system is also presenting a secure or safer technique to drilling severe lost circulation zones in terms of well control during drilling operations, particularly in nationally fractured sour gas reservoirs highly prone to severe mud loss problems.

FIG. 1A is a schematic diagram showing an example wellbore drilling liner system 100 to drill a wellbore in a subterranean formation. The wellbore drilling system 100 includes a drilling liner 105 that can be positioned in a wellbore being drilled in the subterranean formation (described with reference to FIG. 2). In some implementations, the drilling liner 105 can be centered within the wellbore by casing centralizers 114 positioned on an outer surface of the drilling liner 105. An inner work string 109 can be located within (for example, concentrically within) the drilling liner 105 forming a liner annulus 115 between an outer surface of the inner work string 109 and the inner surface of the drilling liner 105. The drilling liner 105 only extends through a portions of the wellbore, such as a lower portion of the wellbore nearest a downhole end of the wellbore.

The system 100 includes a drill head assembly 101 that is attached to a downhole end of the drilling liner 105. In particular, the drill head assembly 101 is attached to a downhole end of the inner work string 109 to form an internal flow path 107 (arrows) through which the wellbore drilling fluid flows to avoid the subterranean formation that surrounds the drilling liner 105. In addition to drilling the subterranean formation to form cuttings, the drill head assembly 101 can receive the wellbore drilling fluids flowed through the drilling liner 105, and flow the cuttings and the wellbore drilling fluids towards the surface through an interior region of the drilling liner 105. As shown by the wellbore drilling fluid flow path 107, the wellbore drilling fluid is flowed from the surface (not shown) in the downhole direction through the inner work string 109, through the drill head assembly 101, and to the surface in the uphole direction through the liner annulus 115. Contact between the wellbore drilling fluid and the lost circulation zone can be minimized or avoided by positioning the drilling liner 105 in the lost circulation zone.

The drill head assembly 101 includes a coring tool 102 and a drilling bit 103 that is attached to the downhole end of the inner work string. The coring tool 102 can include, for example, a tungsten carbide cutter. Certain details of the coring tool 102 and the drilling bit 103 are described later with reference to FIGS. 1B, 1C and 1D, which are schematic diagrams of the drill head assembly 101 of the drilling system 100.

In some implementations, a rotary table, top drive, or similar device at a surface of the wellbore (for example, in a topside facility) can rotate the inner work string 109 to drill the wellbore. In such implementations, such as those shown in FIGS. 1A-1D, a rotation of the inner work string 109 can rotate the drill head assembly 101. In some implementations, a downhole mud motor 106 can be positioned in the drilling liner 105 between a downhole end of the inner work string 109 and an uphole end of the drill head assembly 101 to rotate the drill head assembly 101. Certain details of the mud motor 106 are described later with reference to FIG. 1F, which is a schematic diagram of a cross-section of the mud motor 106. Motor stabilizers 116 can be implemented to keep the mud motor 106 at a center of the drilling liner 105. In such implementations, the mud motor 106 can provide rotation to the drill head assembly 101 in addition to the rotary table. Rotating the drill head assembly 101 using the rotary table and the mud motor 106 can provide an increased rate of penetration (ROP) through the subterranean formation.

Figure 2:
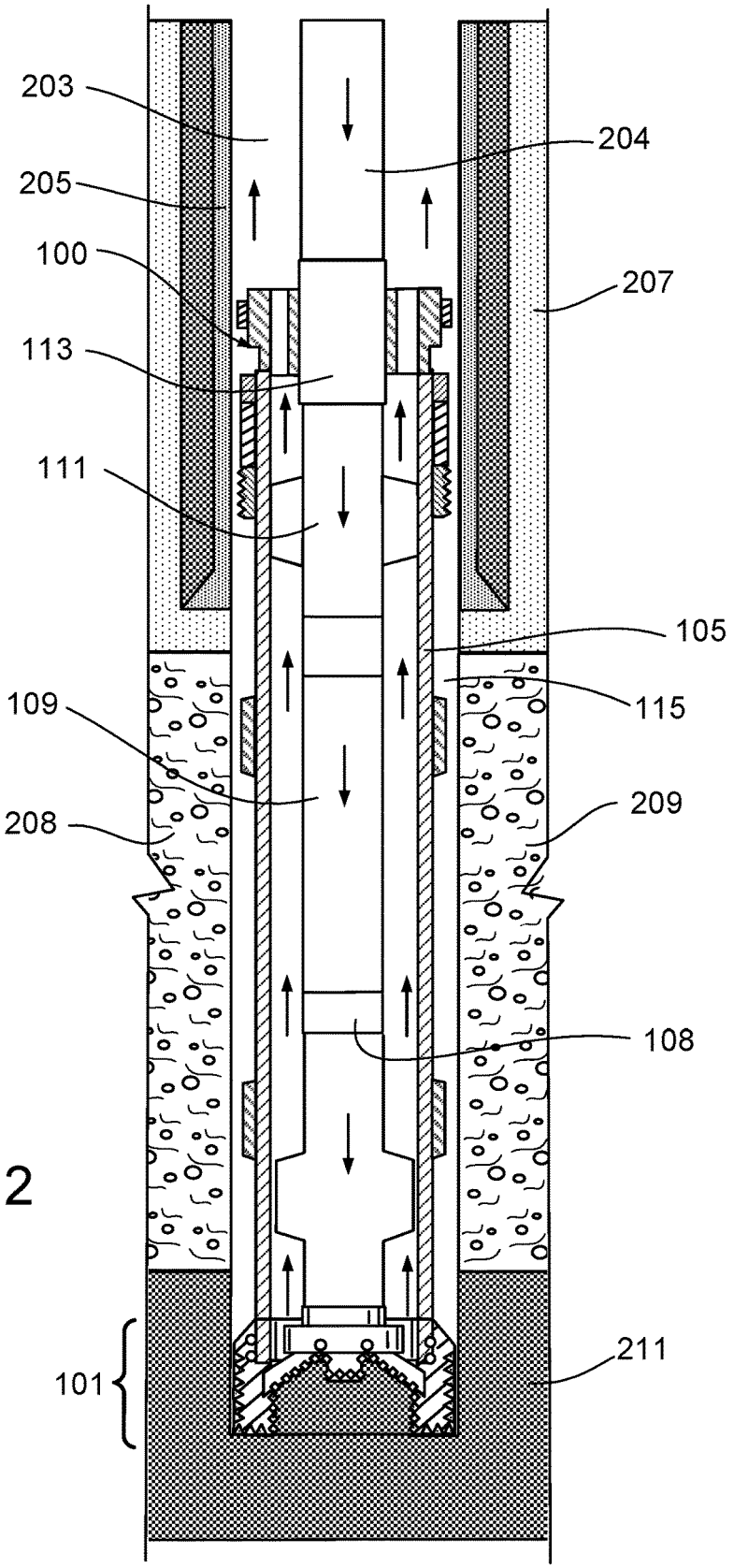
FIG. 2 is a schematic diagram showing deployment of the drilling system while drilling.

The system 100 can include a safety sub 108 between a downhole end of the inner work string 109 and an uphole end of the mud motor 106 or directly the drill bit 103 if the mud motor 106 is not used. The safety sub 108 is a short joint where the inner work string 109 can be easily connected with and can be released at the sub from the tools below in case of emergence where the drill bit or drill head assembly is stuck, unable to move, so that less tools or tubular work string are left in the liner for subsequent fishing operation. The system 100 can include a drilling liner running and setting tool 111 uphole of the inner work string 109 that can position the drilling liner 105, the drill head assembly 101 and the mud motor 106 (if provided) in the subterranean formation in which the wellbore is being drilled. A slip joint 110 can connect the downhole end of the drilling liner running and setting tool 111 and the uphole end of the inner work string 109. In addition, the system 100 can include a return flow control sub-assembly 113 at an uphole end of the system 100 to prevent or mitigate loss of wellbore drilling fluids and to ensure that the wellbore drilling fluids with the cuttings return to a topside facility (not shown). The uphole end of the flow-control sub-assembly 113 is connected to a series of drill pipes that extend the length of the wellbore towards the topside facility. As described later, the drilling liner running and setting tool 111 can pass through a lost circulation zone while fluidically isolating the wellbore drilling fluid from the lost circulation zone. Also, the system 100 can include a liner hanger sub-assembly 112 that can retain the drilling liner 105 across the lost circulation zone after the drilling liner 105 has passed through the lost circulation zone, as shown in FIG. 2. As described later, the liner hanger sub-assembly 112 can maintain the zonal and fluidic isolation of the wellbore drilling fluid and the lost circulation zone.

Figure 1B:
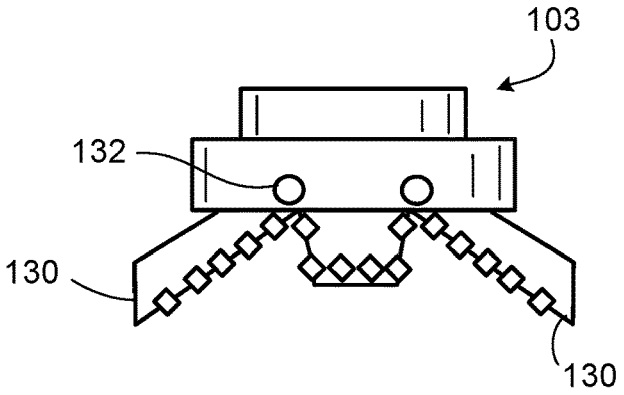
FIGS. 1B, 1C and 1D are schematic diagrams of cross-sectional side views of a drill head assembly of the drilling system.

Details of the drill head assembly 101 are described with reference to FIGS. 1B, 1C and 1D. As shown in FIG. 1B, the drilling bit 103 has cutter arms 130, which have a first end attached to the drilling bit 103 and a second end protruding away from the drilling bit 103. When the drilling bit 103 is positioned within the wellbore, the second end of the drilling bit 103 protrudes toward the subterranean zone and out towards the drilling liner 105 shown in FIG. 1A. The cutter arms 130 of the drilling bit 103 are pivotable about respective pivot locations (for example, pivot location 132) on the drilling bit 103.

Figure 1C:
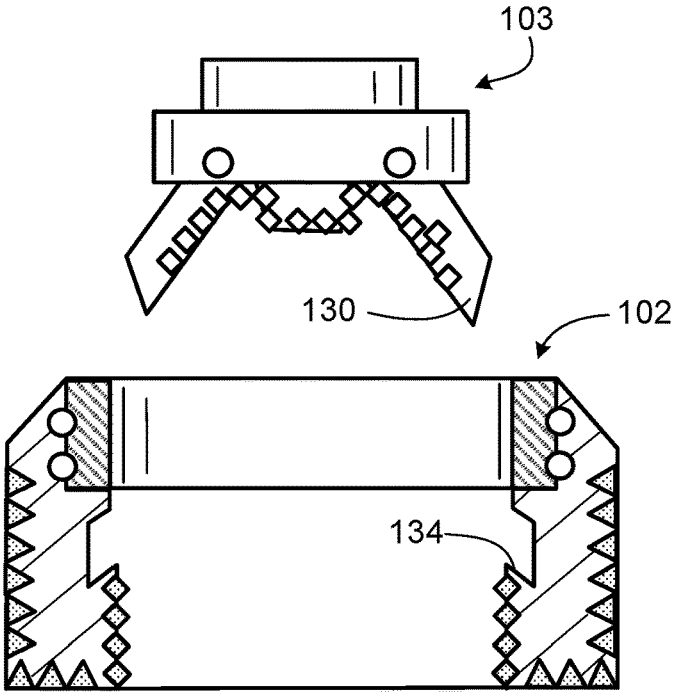

FIG. 1C shows the pivoting action of the cutter arms 130. The coring tool 102 includes notches 134 on an inner surface of the coring tool 102. The notches 134 include integrated flow passages integrated to allow the wellbore drilling fluids to flow to the cutting edge of the coring tool 102. The notches 134 receive the cutter arms 130 of the drilling bit 103. To connect the drilling bit 103 and the coring tool 102, the cutter arms 130 of drilling bit 103 move inward so that the ends of the cutter arms 130 are nearer the center of the inner work string 109. The cutter arms 130 have door-like hinges that naturally spring-bias outward. The cutter arms 103 can be inserted into notches 134 by compressing the arms. The drilling bit 103 is then inserted concentrically into the coring tool 102 and the cutter arms 130 of the drilling bit 103 are released, for example, by over-pulling from above, so that the ends of the cutter arms 130 pivot away from the center of the inner work string 109. The compressed cutter arms 130 are inserted into the notches 134 on the coring tool 102 as shown in FIG. 1D.

Multiple bearings 104 (for example, ball bearings or other bearings) can be disposed at an interface between the drill head assembly 101 and the drilling liner 105. The multiple bearings 104 can allow the drill head assembly 101 to rotate independently of the drilling liner 105 shown in FIG. 1A. The interface between the drill head assembly 101 and the drilling liner 105 can form a portion of the internal flow path 107 through which the wellbore drilling fluid flows without contacting the subterranean formation that is being drilled. The interface can but need not seal the inner portion of the drilling liner 105 to completely prevent loss of wellbore drilling fluids into the lost circulation zone. Rather, a side wall of the drill head assembly 101 isolates the subterranean formation as it is being drilled, thereby preventing significant wellbore drilling fluid loss at the drilling bit 103. In this manner, the system described here can prevent mud losses mostly since some mud seepage loss could still occur below the drill bit in case of encountering a highly fractured rock formation. Such amount can be negligible, however, because the coring head can act like a barrel or isolating wall. The center part of the rock core is the potential fluid flow passage; thus, the longer the core, the lesser the mud loss.

Figure 1D:
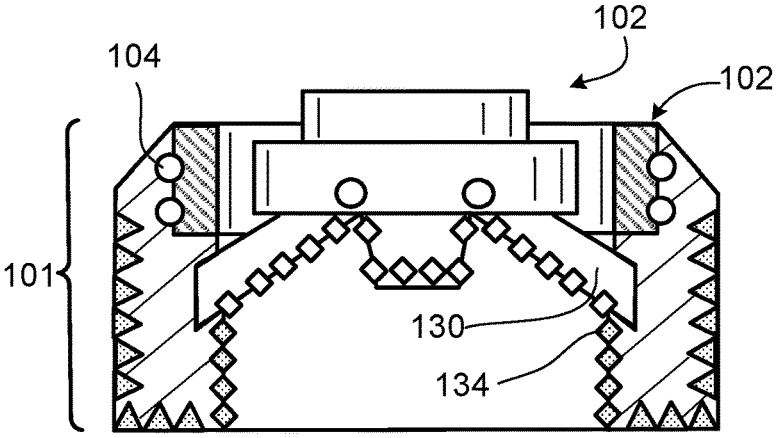
Figure 1E:
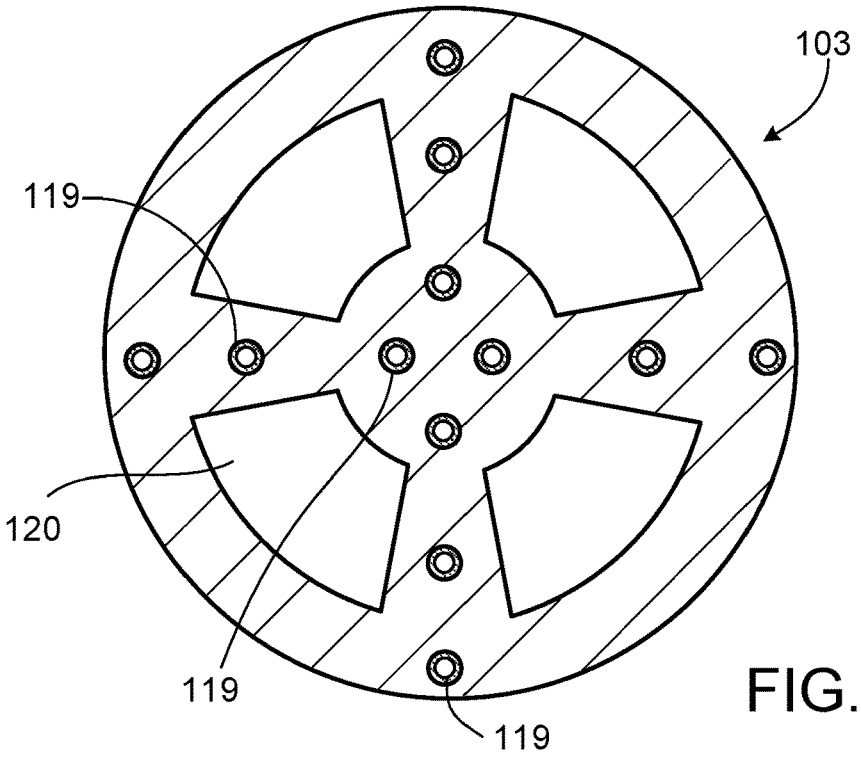
FIG. 1E is a schematic diagram of a top down cross-section of a drilling bit of the drilling system.

FIG. 1E is a schematic diagram of a cross-section of the drilling bit 103 shown in FIG. 1A. The drilling bit 103 shown in FIG. 1A can be a retrievable polycrystalline diamond compact (PDC) cutter with multiple nozzles 119 through which the wellbore drilling fluid flows. The coring tool can have a hollow center part with a size tailored to match that of the drilling liner. The coring tool can additionally have the notches described earlier to connect and link the drill bit. The drill bit can have multiple pivotable cutter arms enabling easy assembly and retrieval. The coring tool 102 (first shown in FIG. 1A) can core the subterranean formation in which the wellbore is being drilled. The drilling bit 103, which is attached to the downhole end of the inner work string 109, can cut a core cored by the coring tool 102. As shown in the cross-section of FIG. 1E, the drilling bit 103 can include nozzles 119 and a flow passage 120 through which the wellbore drilling fluid flows to carry the cuttings through the flow path 107 in the liner annuls 115.

The drilling bit 103, as shown in FIG. 1D, can have a concaved face curving in the uphole direction. The coring tool 102 can be positioned downhole of and between the drilling bit 103 and the subterranean formation. For example, a distance between the downhole end of the coring tool 102 and the drilling bit 103, in some instances, is up to three feet in length. In general, the factors influencing the distance between the downhole end of the coring tool 102 and the drill bit 102 include one or more of the rock formation and the power of the mud motor. For example, for highly, naturally fractured formation, the distance can be up to several feet so that less mud loss occurs through the core. However, as the distance increases, the work done by the coring tool to cut rock can increase, resulting in increased wear. In a compact rock formation, on the other hand, the distance can be less, for example, as little as 1 foot. The mud motor power to rotate the coring tool can be high for a longer core barrel. In some instances, the mud motor can be avoided and the rotation of the work string can be used for coring. In such instances, the distance is less of a concern compared to rate of penetration (ROP). In operation, the coring tool 102 rotates to create a core from the subterranean formation and the drilling bit 103 rotates to grind the core into cuttings, which the wellbore drilling fluid carries through the liner annulus 115 of the drilling liner 105 thereby minimizing or avoiding contact between the wellbore drilling fluid and the subterranean formation that is being drilled.

Figure 1F:
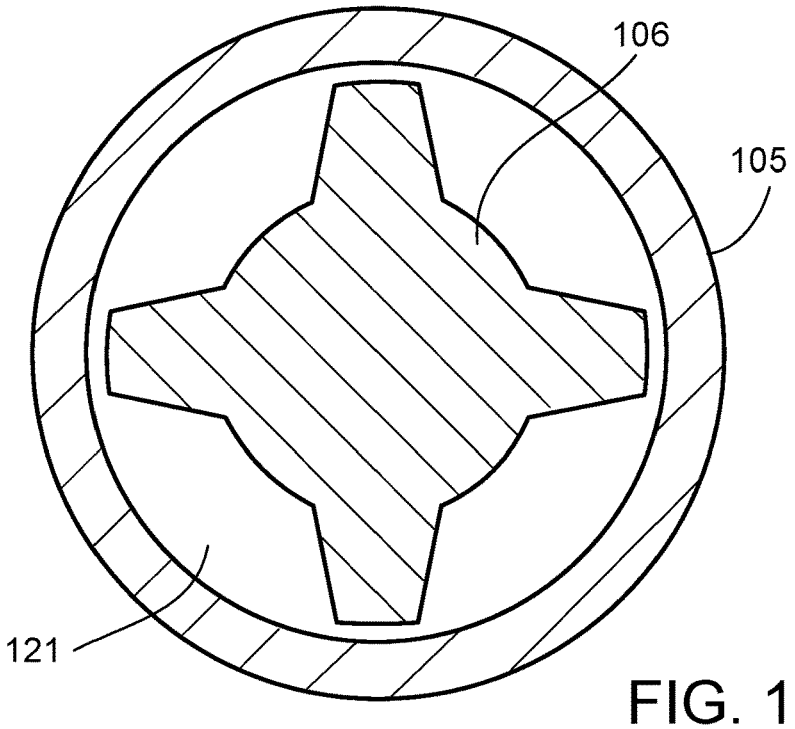
FIG. 1F is a schematic diagram of a top-down cross-section of a mud motor of the drilling system.

Turning to the mud motor 106, as shown in FIG. 1F, the mud motor 106 can be, for example, a positive displacement hydraulic motor that can be powered by the wellbore pressurized drilling fluid with certain flowrates flowed through the inner work string 109. The mud motor 106 can be formed and positioned in the drilling liner 105 to form flow passages 121 through which the wellbore drilling fluid flows.

Example techniques to drill through a lost circulation zone using the system 100 are described with reference to FIG. 2, which is a schematic diagram showing deployment of the drilling system 100 while drilling. FIG. 2 shows a wellbore 208 having been drilled through three different zones in the subterranean formation. A zone can include a formation, a portion of a formation or multiple formations. The wellbore 208 has been formed through the first zone 207 and a casing 205 has been installed in the first zone 207. The casing 205 and a drill string 204 lowered into the wellbore 208 define an annulus 203 through which wellbore drilling fluids and cuttings flow in the uphole direction toward the surface of the wellbore 208.

The second zone 209 is a lost circulation zone that is downhole of the cased first zone 207. For example, the second zone 209 includes large and naturally fractured formation with open fractures with width potentially in the order of inches. In the second zone 209, the fracture domain is inter-connected throughout a wide area. The pre-existing pore pressure in the second zone 209 is lower or substantially lower than the mud column hydrostatic pressure in the wellbore 208. Consequently, a portion of or all of fluid flowed through the second zone 209 in the uphole direction can be lost in the second zone 209. For example, when a volume of fluid is flowed through the wellbore 208 in contact with the second zone 209, there is no circulating mud returned to the surface even though the surface mud pumps are operational, this is commonly called total loss environment, drilling in this environment consumes a large of volume of mud per hour, considering also of a mud cap process commonly adopted in the field (i.e., pumping mud in the backside between drillpipe and surface casing to fill the wellbore with mud for well control or safety concern), hence this kind of drilling practice can't last long since it would be a major logistical concern with a large cost implication daily. However, if the problem is less severe, the fraction of the volume that is lost in the second zone 209 is higher than the fraction of the volume that flows to the surface of the wellbore 208, commonly called loss of circulation, or strictly speaking partial mud losses into the second zone 209. The system disclosed here is designed to address the severe problem of the total mud losses, it can also of course address the lesser problem such as partial mud losses.

The third zone 211 is downhole of the second zone 209 and is a competent formation that does not experience significant loss of wellbore drilling fluid. That is, the third zone 211 is not a lost circulation zone like the second zone 209. Without the drilling system 100 described, if the wellbore drilling fluid were flowed through the drill string 204 and through a drill head assembly while drilling in the second zone 209, a significant portion of the wellbore drilling fluid would be lost to the second zone 209. Thus, upon determining that the zone in which the wellbore 208 is being drilled is a lost circulation zone, like the second zone 209, the drilling system 100 described earlier can be deployed to drill through the second zone 209 while mitigating loss of the wellbore drilling fluid to the second zone 209.

The system 100 can be deployed upon encountering the second zone 209 or prior to drilling into the zone 209. For deployment, the system 100 (shown in FIG. 1A) is run in hole with a pre-assembled bottom assembly that includes the coring tool 102, drilling bit 103, mud motor 106, and a safety sub 108, which collectively form the lower part of the inner work string 109 and are placed downhole. The lower part of the inner work string 109 is lowered into the wellbore 208 with sections of liner being added to the assembly until the necessary liner length is attached. The necessary length of the drilling liner 105 can depend on the length of the wellbore 208 that will be in the second zone 209, that is, the lost circulation zone, plus overlap section of the previous casing and short section in the zone 211. Once the proper length is reached, a top joint of a liner is attached. Sections of the inner work string 109 are connected to the lower part of the inner work string 109, and are run in-hole and connected to the safety sub 108. Then, the pre-assembled liner running and setting tool 111 with the liner hanger sub-assembly 112 and flow control sub-assembly 113 on the uphole end are attached into the adjustable slip joint 110 and made-up with top joint of drilling liner 105.

Figure 3:
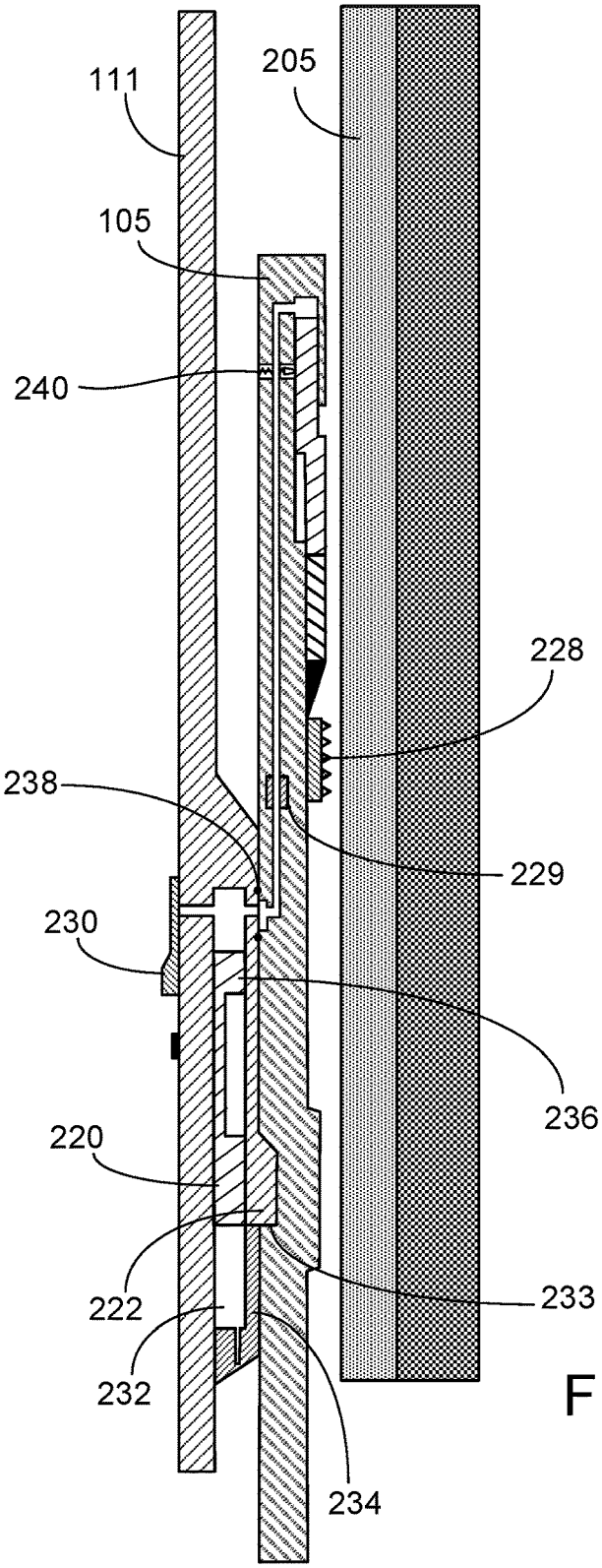
FIG. 3 is a schematic diagram showing a detailed view of the drilling liner running and setting tool.

FIG. 3 shows the liner running and setting tool 111 fully engaged so that it can transfer torque from the inner work string 109 to the drilling liner 105. The torque from the inner work string 109 is transmitted to the drilling liner 105 via a collet 222 that extends radially outward from the liner running and setting tool 111 and fits into a slot 233 in the drilling liner 105. The collet 222 is held in place by a collet retaining nut 220, which, in turn, is held in place by a shear pin 236. The shear pin 236 is designed to hold the collet retaining nut 220 in a first position until the liner running and setting tool is removed from the wellbore 208. When the liner running and setting tool 111 has been fully engaged, the drilling liner 105 can drill through the second zone 209 (shown in FIG. 2). As the drilling liner 105 drills through the second zone 209, the return flow control sub-assembly 113

(shown in FIG. 2) flows the wellbore drilling fluids from the liner annulus 115 (shown in FIG. 2) to the annulus 203 (shown in FIG. 2) thereby avoiding contact with the second zone 209. Additional features of the liner running and setting tool 111 (for example, a hanger 228, a check valve 229, a ball seat 230, a movement chamber 232, a chamber isolating housing 234, a shear pin 236, elastomeric seals 238, and a spring loaded locking pin 240), which can disengage the drilling liner running and setting tool 111 from the drilling liner 105 are shown in FIG. 3 and described in detail with reference to FIG. 5A.

Figure 4B:
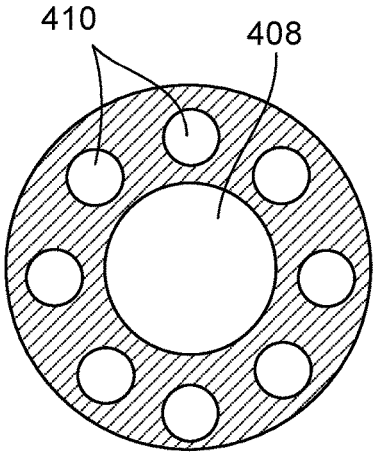
FIGS. 4A, 4B and 4C are schematic diagrams of a return flow control subsystem of the drilling system.
Figure 4A:
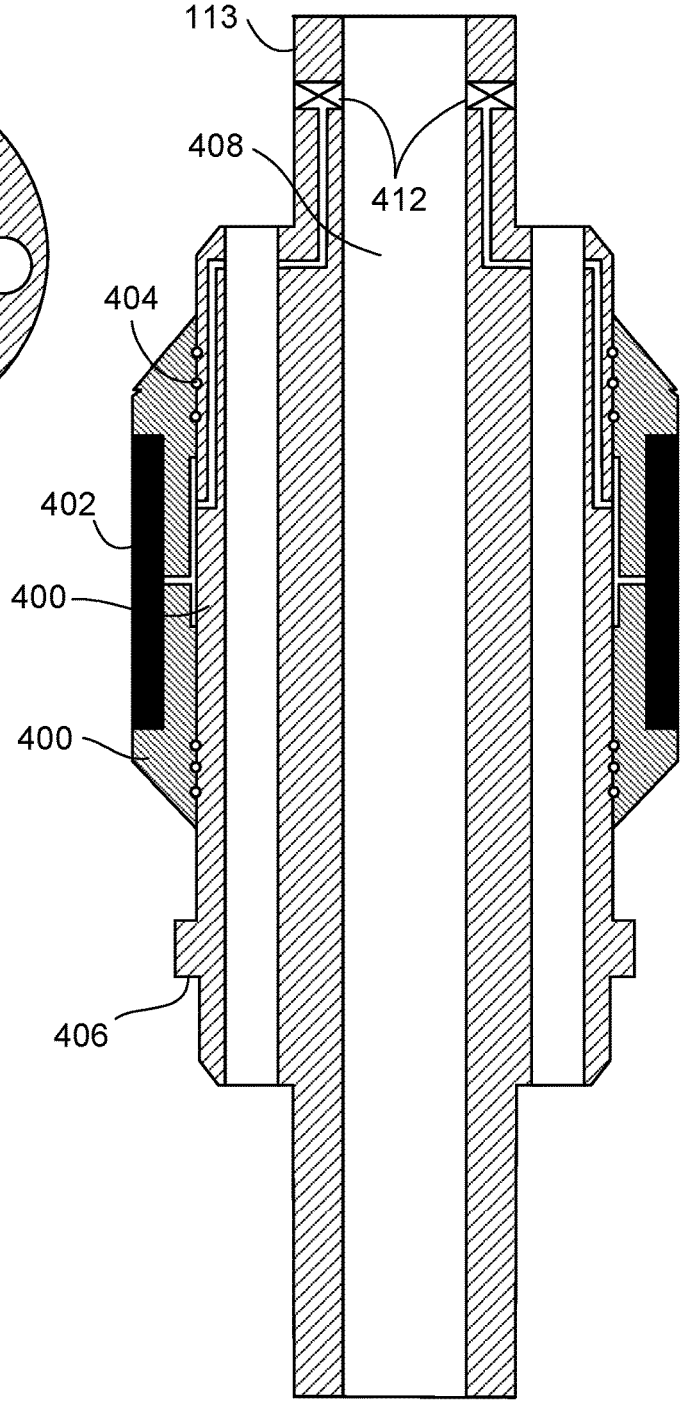
Figure 4C:
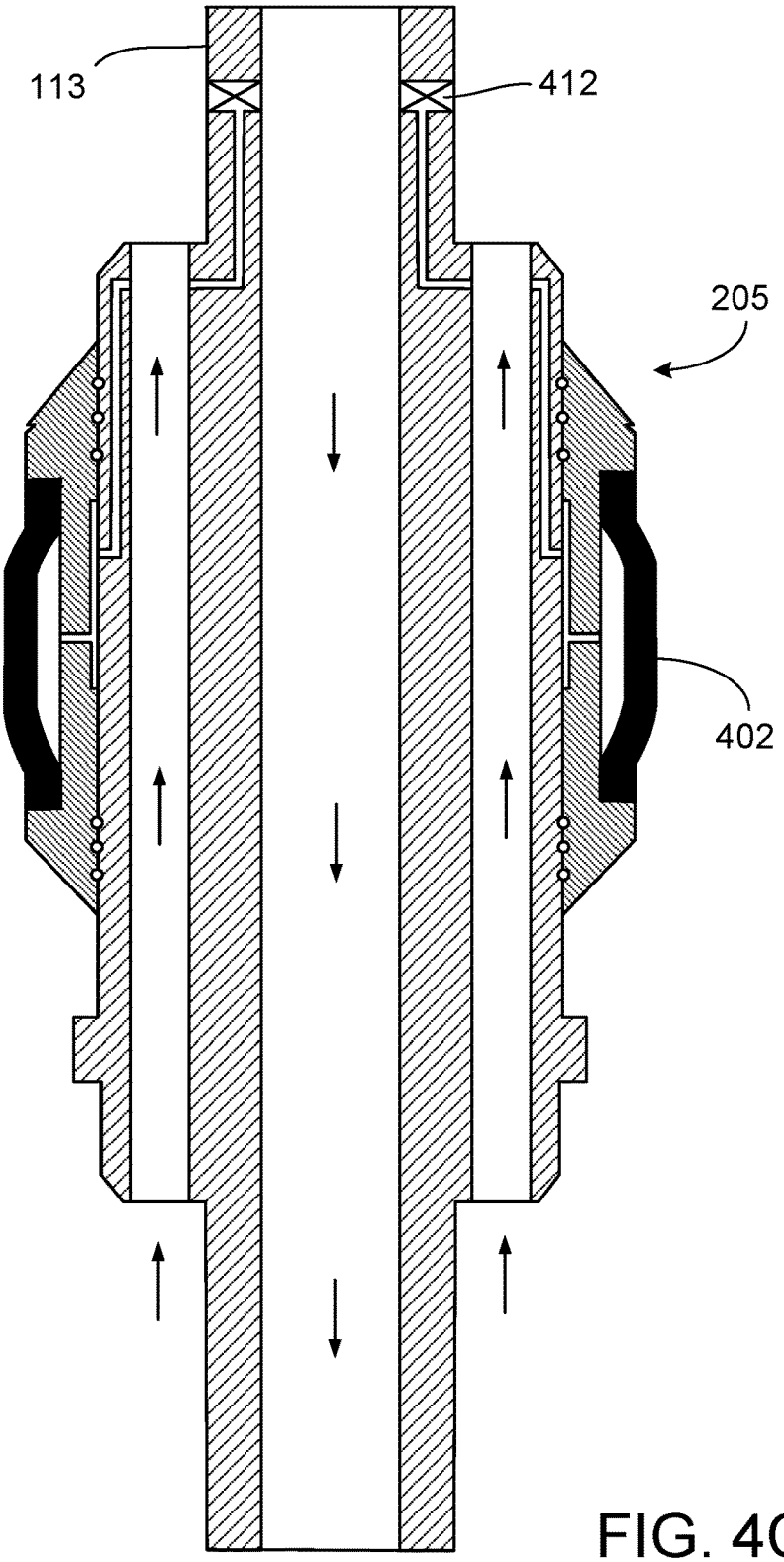

FIGS. 4A, 4B and 4C are schematic diagrams showing the return flow control sub-assembly 113, which is positioned uphole of the liner running and setting tool 111 (shown in FIGS. 2 and 3) either in the drilling liner 105 (shown in FIGS. 2 and 3) or the wellbore casing 205 (shown in FIG. 2). As shown in FIG. 4A, the return flow control sub-assembly 113 includes of an inner body 400 surrounded by the inflatable packer 402. The packer 402 can be a cased-hole inflatable packer and can be under-gauged when it is not set, for example, by about one-quarter inch, than the internal diameter of the previous casing 205. The under gauge is based on running hole clearance, and is used for running in-hole when the packer 402 is not set to allow fluid to fill in the gap between the drilling liner and wellbore, and to prevent pressure surge when running in hole, which otherwise may induce more mud losses. The packer 402 can have a tungsten carbide body and can act as a sealable isolation barrier for diverting flows.

Multiple bearings 404 can be positioned between the inner body 400 and the inflatable packer 402. The multiple bearings 404 allow rotation of the inner body 400 independently of the inflatable packer 402. A stop ring 406 is attached to the flow control sub-assembly 113 downhole of the packer 402. The stop ring 406 resides at a top of the drilling liner 105 and diverts the wellbore drilling fluids mixed with the cuttings away from the uncased wellbore 208 (shown in FIG. 2) in an uphole direction through inner flow channels in the return flow control sub-assembly 113.

The return flow control sub-assembly 113 includes a central flow passage 408 that is connected to the inner work string 109 and carries drilling fluids in a downhole direction from the surface through the drill string 204 (shown in FIG. 2). The flow control sub-assembly 113 is attached to the inner work 109 prior to being deployed into the wellbore 208. The central flow passage 408 is surrounded radially by a series of flow passages 410 (FIG. 4B) that direct the flow of drilling fluids and cuttings from the drill head assembly 101 (shown in FIG. 2) in the uphole direction towards wellbore casing annulus 203 (shown in FIG. 2) and the surface. The small flow passages separated from flow passages 410, as shown in FIG. 4A, enable setting the packer 402. In some implementations, the packer 402 is engaged by a set of disk valves 412 that operate based on the pressure differential between the inner work string 109 and the wellbore annulus 203 (shown in FIG. 2) when the system 100 (shown in FIGS. 1A-1D) is working at steady state. The disk valves 412 allow fluid to flow through the small flow passages in the flow control sub-assembly 113 and to the packer 402.

FIG. 4C shows the packer 402 in its inflated state. As described earlier, the packer 402 is inflated by a pressure differential driven by the flow of wellbore drilling fluids through the system 100 (shown in FIGS. 1A-1D) by one or more mud pumps at the surface (not shown). When the pressure in the inner work string 109 (shown in FIG. 2) or the drill string 204 (shown in FIG. 2) is greater than a corresponding annulus pressure, the disk valves 412 open to permit passage of the wellbore drilling fluids through the small flow passages (shown in FIG. 4B) to inflate the packer 402. The packer 402 at least partially seals the return flow control sub-assembly 113 to either the inner wall of the wellbore casing 205 (shown in FIG. 2) or the inner wall of the drilling liner 105 (shown in FIG. 2). When the mud pumps are deactivated, the packer element is unset. In this manner, the return flow control sub-assembly 113 eliminates wellbore drilling fluids loss while the drilling liner 105 (shown in FIG. 2) drills through a lost circulation zone, for example, the second zone 209 (shown in FIG. 2).

After drilling through the second zone 209 (shown in FIG. 2), when the drill head assembly 101 (shown in FIG. 2) encounters the third zone 211 (shown in FIG. 2), the drilling liner 105 (shown in FIG. 2) can be set. The drilling liner setting point in the third zone 211 (shown in FIG. 2) can be determined, for example, by surface geological sampling of returned cuttings and or rate of penetration or available length of the drilling liner. The drilling liner 105 (shown in FIG. 2) can be set using the liner hanger sub-assembly 112 (shown in FIG. 1A) to zonally isolate the second zone 209 (shown in FIG. 2).

Figure 5A:
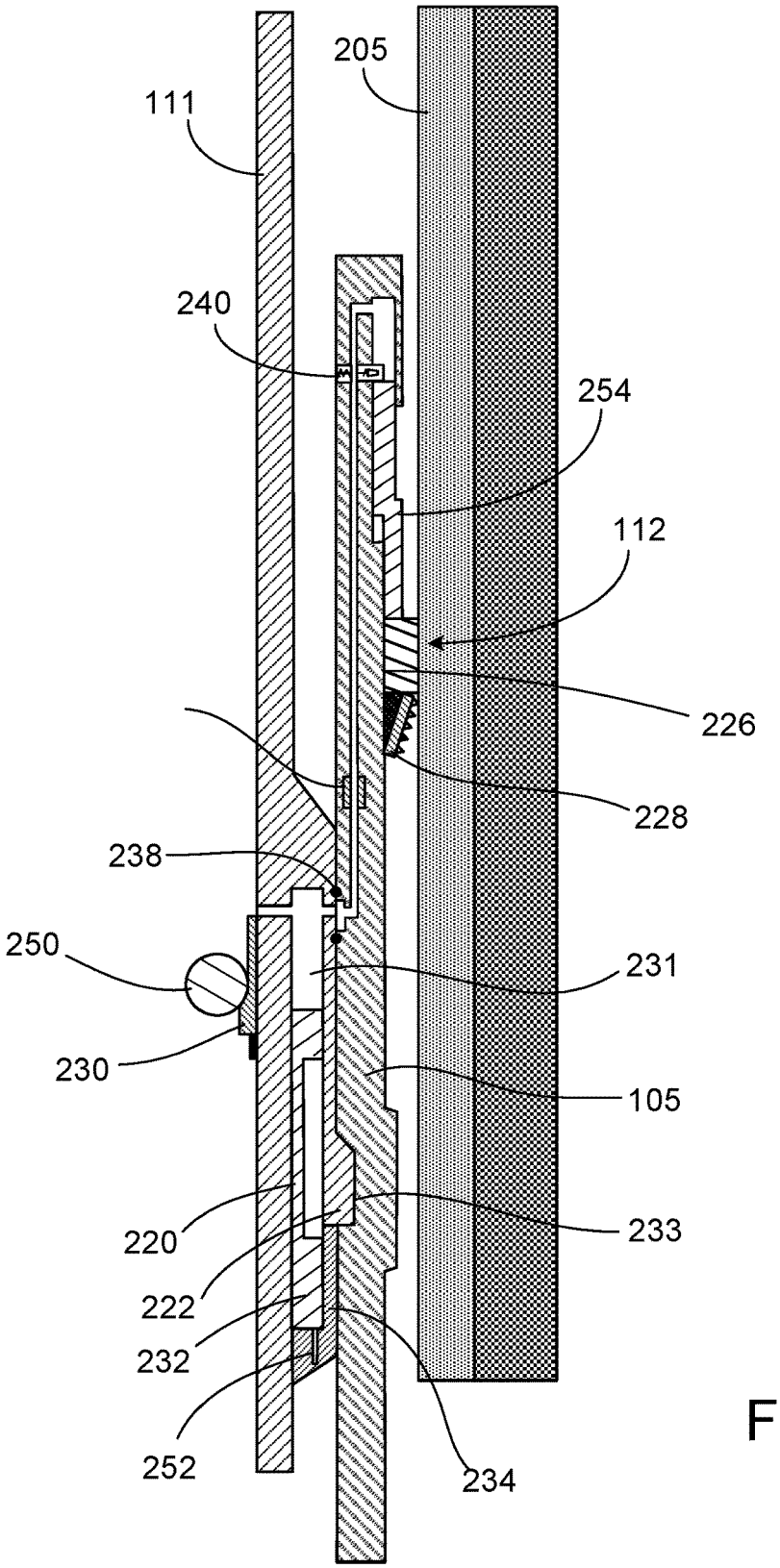
FIGS. 5A and 5B are schematic diagrams showing the drilling liner of the drilling system set inside the wellbore.
Figure 5B:
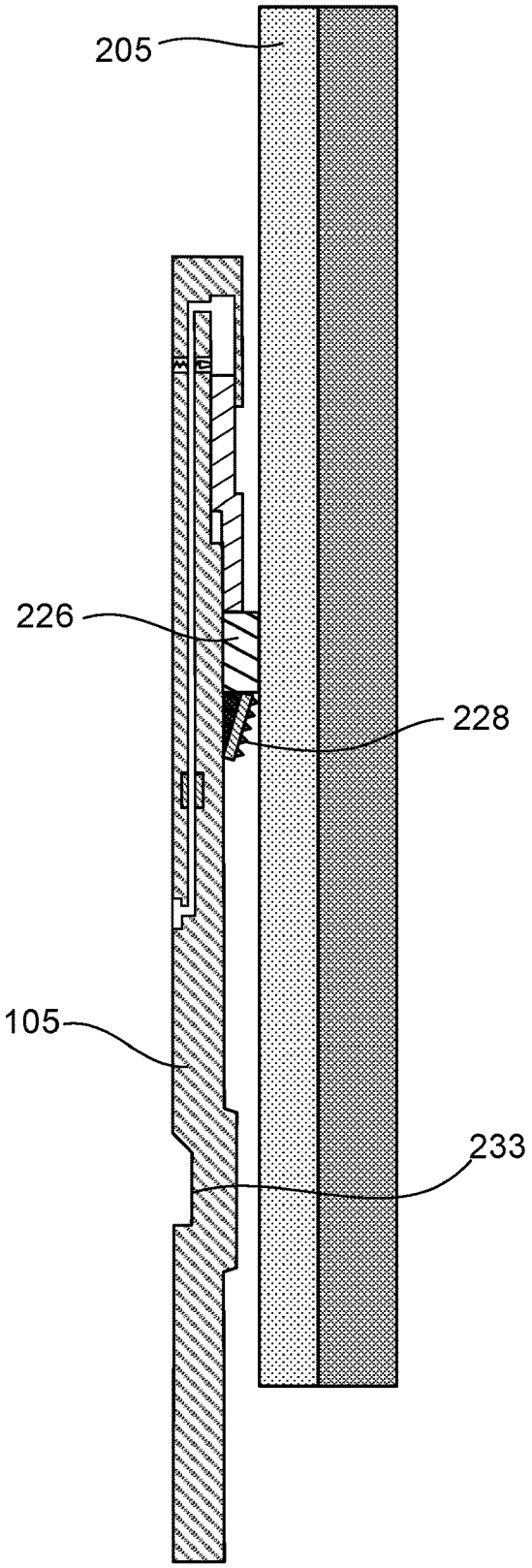

FIG. 5A shows disengaging the drilling liner running and setting tool 111 from the drilling liner 105. The liner hanger and top packer assembly 112 includes a packer 226 and a hanger 228. The packer 226 is flexible and is easily deformed to create a seal between the drilling liner 105 and the wellbore casing 205. The liner hanger 228 is expanded radially outward by the compression of the packer 226. The hanger 228 has small teeth that can bite into the wellbore casing 205 when engaged. The hanger 228 can carry the weight of the drilling liner system 100 (shown in FIGS. 1A-1D) when engaged. To disengage the drilling liner running and setting tool 111 from the drilling liner 105 in some implementations, a ball 250 can be dropped down (arrow) the inner work string 109 (shown in FIG. 2) from the surface. The ball 250 engages the ball seat 230 and allows pressure to enter (arrow) a chamber 231 uphole of the collet retaining nut 220, causing the shear pin 236 (shown in FIG. 3) to break and the collet retaining nut 220 to shift downhole (arrow) into a collet nut movement chamber 232 until the collet retaining nut 220 is stopped by the edge of the chamber isolating housing 234. The chamber isolating housing 234 has a vent hole 252 on the downhole side to allow any well fluids to escape as the collet retaining nut 220 slides in the downhole direction. The movement of the collet retaining nut 220 allows the collet 222 to move uphole when the string is pulled up to the surface. The collet nut movement chamber 232 is connected to the drilling liner 105 and is sealed against the liner with elastomeric seals 238, for example, one or more O-rings. The pressure from the collet nut movement chamber 232 is able to pass through a check-valve 229 to the liner hanger and top packer assembly 112. The pressure introduced by the engaged ball seat 230 forces a packer setting mandrel 254 to move downhole slightly (arrow) to compress the packer 226. A spring loaded locking pin 240 (to prevent packer unset) is engaged after the packing nut (not shown) compresses the packer 226. As the packer 226 is compressed and set, the packer 226 engages the liner hanger 228 to hang the drilling liner 105 from the wellbore casing 205. The teeth of the liner hanger 228 bite into the wellbore casing 205. The drilling liner 105 is then secured, sealed, and hanging without the aid of the drill string (not shown). The liner running and setting tool 111 can be removed with a simple over-pull from the drilling liner 105. FIG. 5B shows the drilling liner 105 secured to the wellbore casing 205 after the liner running and setting tool 111 has been removed.

Figure 6:
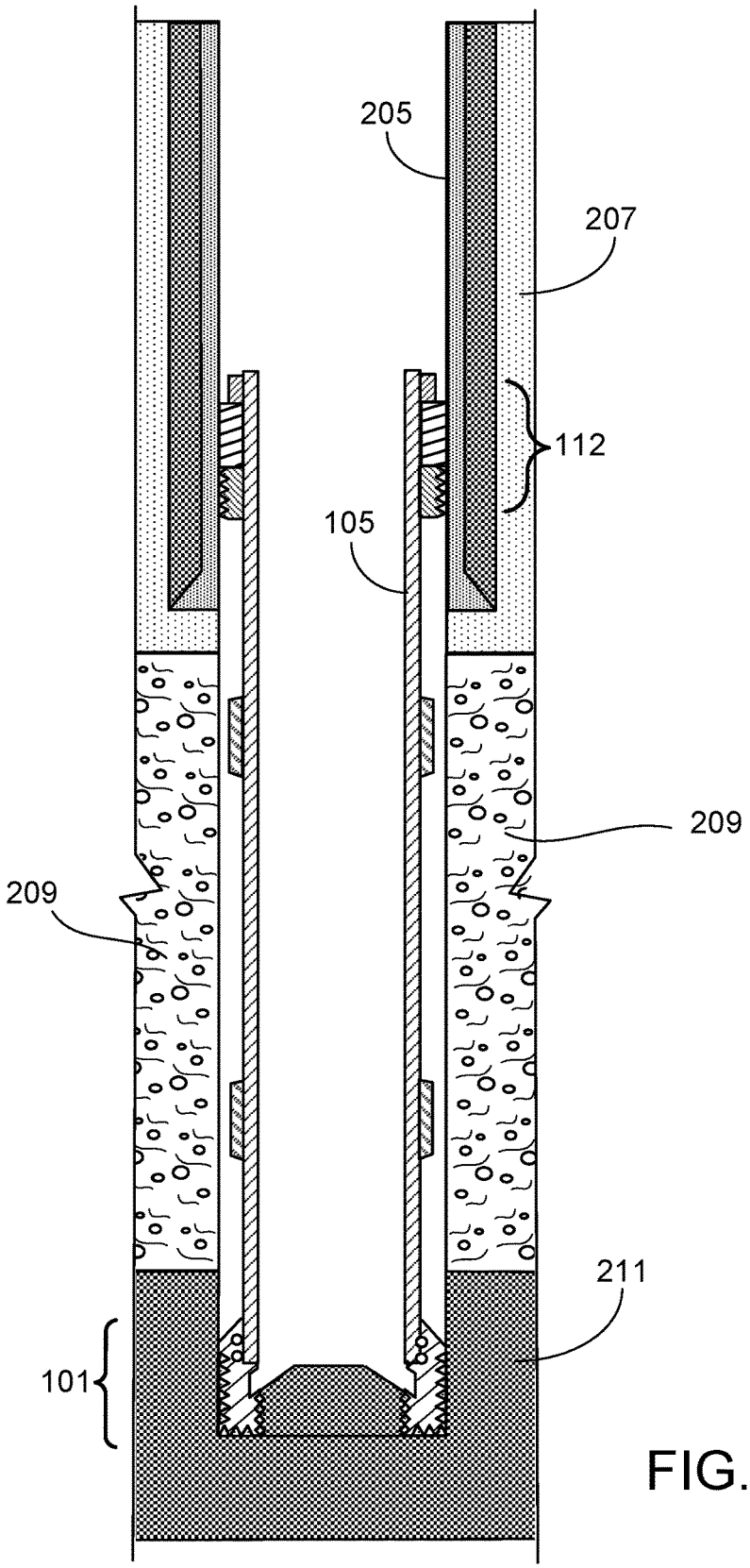
FIG. 6 is a schematic diagram showing the drilling liner set inside a lost circulation zone.

FIG. 6 is a schematic diagram showing the drilling liner 105 set inside the wellbore 208, particularly, in the second zone 209. When the drill head assembly 101 encounters the third zone 211, the drilling liner 105 can be set as described earlier. To do so, as described earlier, the liner hanger sub-assembly 112 can be deployed. A portion of the drilling liner 105 spans an entire length of the second zone 209, and additionally extends into the first zone 207. In some implementations, at least a portion of the drilling liner 105 on the uphole end of the wellbore 208 is positioned within a wellbore casing 205. Thus, when the drill head assembly 101 is deployed, the liner annulus 115 (shown in FIG. 2) formed by the inner work string 109 (shown in FIG. 2) and the drilling liner 105 minimizes or prevents the wellbore drilling fluids from contacting the second zone 209. As drilling continues through and into zones downhole of the second zone 209, the wellbore drilling fluid is flowed downhole through the inner work string 109 (shown in FIG. 2), through the drill head assembly 101, into the liner annulus 115 (shown in FIG. 2), into the annulus 203 (shown in FIG. 2) and in the uphole direction. Any loss of wellbore drilling fluid is limited to fluid that flows into the subterranean formation through the nozzles 119 (shown in FIG. 1E) in the drilling bit 103 (shown in FIG. 1E). In this manner, loss of wellbore drilling fluid to the lost circulation zone, that is, the second zone 209, is minimized or eliminated.

Figure 7:
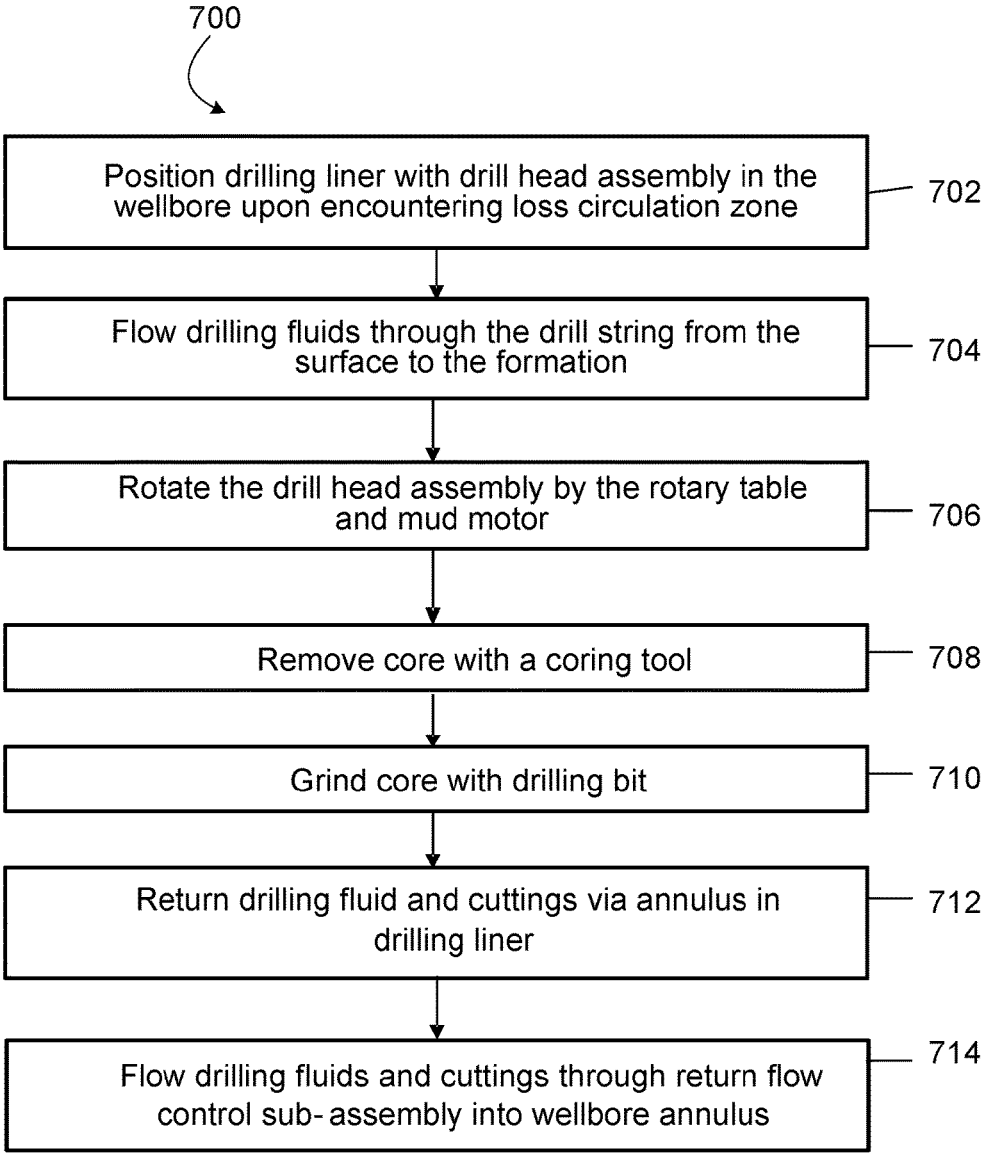
FIG. 7 is a flowchart of a process for wellbore drilling using the drilling system.

FIG. 7 is a flowchart of an example process 700 implemented by the drilling liner system. At 702, the drilling liner 105 with the drill head assembly 101 is positioned in the wellbore 208 upon encountering a lost circulation zone, for example, the second zone 209. At 704, drilling fluids are flowed through the drill string 204 from the surface to the formation. At 706, the drill head assembly 101 is rotated by the rotary table and the mud motor 106. At 708, a core from the second zone 209 is created with the coring tool 102. At 710, the created core is grinded with the drilling bit 103. At 712, the wellbore drilling fluids and cuttings are returned via the annulus in the drilling liner 105. At 714, the drilling fluids and the cuttings are flowed through the return flow control sub-assembly 113 into the wellbore annulus 203. In this manner, a flow path through which the wellbore drilling fluid is flowed to the subterranean formation is isolated from a lost circulation zone of the subterranean formation. While drilling a wellbore through the lost circulation zone, the wellbore drilling fluid is circulated through the flow path while avoiding contact between the wellbore drilling fluid and the lost circulation zone.

A number of implementations been described. Nevertheless, it will be understood that various modifications may be made without departing from the spirit and scope of the disclosure.

The invention claimed is:

1. A wellbore drilling system comprising:

a drilling liner configured to be positioned in a lost circulation zone of a subterranean formation in which a wellbore is being drilled, the drilling liner configured to flow wellbore drilling fluids from a surface of the wellbore to the subterranean formation while avoiding the lost circulation zone;

a drill head assembly attached to a downhole end of the drilling liner, the drill head assembly configured to:
drill the subterranean formation to form cuttings,
receive the wellbore drilling fluids, and
flow the cuttings and the wellbore drilling fluids into the drilling liner while avoiding the lost circulation zone and towards the surface of the wellbore; and a liner running and setting tool attached to an uphole end of the drilling liner, the liner running and setting tool configured to position the drilling liner in the lost circulation zone and to transfer torque to rotate the drilling liner.

2. The system of claim 1, further comprising an inner work string configured to be positioned in the drilling liner, wherein a liner annulus is defined between an outer surface of the inner work string and an inner surface of the drilling liner.

3. The system of claim 1, further comprising a mud motor attached to the inner work string between the drill head assembly and the inner work string, the mud motor configured to rotate the drill head assembly.

4. The system of claim 1, wherein the drill head assembly is attached to a downhole end of the inner work string to form a closed flow path through which the wellbore drilling fluids flow to avoid the lost circulation zone.

5. The system of claim 1, wherein the drill head assembly is configured to receive the wellbore drilling fluids flowed through the inner work string and to flow the wellbore drilling fluids and the cuttings into the liner annulus.

6. The system of any claim 1, wherein the drill head assembly comprises:

a coring tool configured to core the subterranean formation in which the wellbore is being drilled, and a drilling bit attached to the inner work string, the drilling bit configured to cut a core cored by the coring tool.

7. The system of claim 6, wherein the coring tool is positioned between the drilling bit and the subterranean formation.

8. The system of claim 6, wherein a distance between a down hole end of coring tool and the drilling bit is substantially three feet.

9. The system of claim 1, further comprising a plurality of bearings at an interface of the drilling liner and the coring tool, the plurality of bearings configured to allow the coring tool to rotate independently of the drilling liner.

10. The system of claim 9, wherein the drilling bit comprises cutter arms comprising:

a first end attached to the drilling bit; and a second end protruding away from the drilling bit and toward the subterranean zone, wherein the coring tool comprises a notch on an inner surface of the coring tool, the notch configured to receive the cutter arms of the drilling bit.

11. The system of claim 10, wherein the plurality of bearings is positioned uphole of the notches.

12. The system of claim 1, wherein the cutter arms of the drilling bit are pivotable about respective pivot locations on the drilling bit toward and away from a longitudinal axis of the drilling liner.

13. The system of claim 1, further comprising a return flow control subsystem attached to an uphole end of the drilling liner, the return flow control subsystem configured to receive and flow the wellbore drilling fluid and the cuttings to flow towards the surface of the wellbore.

14. The system of claim 13, wherein the return flow control subsystem comprises:

an inflatable packer configured to seal the drilling liner against the wellbore casing; and flow passages to flow the drilling fluids mixed with the cuttings from the liner annulus to the wellbore casing annulus.

15. The system of claim 13, wherein the return flow control subsystem comprises:

an inner body surrounded by the inflatable packer; and a plurality of bearings positioned between the inner body and the inflatable packer, the plurality of bearings configured to allow rotation of the inner body independently of the inflatable packer.

16. The system of claim 13, wherein at least a portion of the return flow control subsystem is positioned within a wellbore casing.

17. The system of claim 1, wherein the drilling liner comprises a stop ring configured to be attached at a location downhole from the return flow control subsystem, wherein the stop ring is configured to divert the wellbore drilling fluids mixed with the cuttings towards the flow passages.

18. The system of claim 1, further comprising a drilling liner running and setting tool configured to position the drilling liner, the drill head assembly and the return flow control subsystem in the subterranean formation in which the wellbore is being drilled.

19. The system of claim 1, wherein at least an uphole portion of the drilling liner is positioned within a wellbore casing.

* * * * *